US010022740B2

(12) United States Patent
Van Swieten et al.

(10) Patent No.: US 10,022,740 B2
(45) Date of Patent: Jul. 17, 2018

(54) DISPENSER AND METHOD FOR DISPENSING FLUIDS FROM A FLUID CONTAINER

(71) Applicant: Q-Invest B.V., Vlijmen (NL)

(72) Inventors: Roy Edwin Van Swieten, Hedel (NL); Johannes Hubertus Jozef Maria Kelders, Riederalp (CH)

(73) Assignee: Airopack Technology Group B.V., Waalwijk (NL)

( * ) Notice: Subject to any disclaimer, the term of this patent is extended or adjusted under 35 U.S.C. 154(b) by 0 days.

(21) Appl. No.: 14/905,835

(22) PCT Filed: Jul. 21, 2014

(86) PCT No.: PCT/NL2014/050494

§ 371 (c)(1),
(2) Date: Jan. 18, 2016

(87) PCT Pub. No.: WO2015/009157

PCT Pub. Date: Jan. 22, 2015

(65) Prior Publication Data

US 2016/0158778 A1 Jun. 9, 2016

(30) Foreign Application Priority Data

Jul. 19, 2013 (NL) ..... 2011199

(51) Int. Cl.

| | |
|---|---|
| ***B67D 7/58*** | (2010.01) |
| ***B05B 11/00*** | (2006.01) |
| ***B65D 83/20*** | (2006.01) |
| ***B65D 83/34*** | (2006.01) |
| ***B65D 83/14*** | (2006.01) |

(52) U.S. Cl.
CPC ..... *B05B 11/3047* (2013.01); *B05B 11/3053* (2013.01); *B65D 83/207* (2013.01); *B65D 83/34* (2013.01); *B65D 83/753* (2013.01); *B05B 11/3097* (2013.01)

(58) Field of Classification Search
CPC ..... B05B 11/3047; B05B 11/3053; B05B 11/3097; B65D 83/207; B65D 83/34; B65D 83/753; F16K 23/00
USPC ..... 222/380, 108, 571, 494
See application file for complete search history.

(56) References Cited

U.S. PATENT DOCUMENTS 3,138,301 A 6/1964 Ward
3,991,916 A * 11/1976 Del Bon ..... B05B 1/32 222/402.13
5,099,885 A * 3/1992 Nilsson ..... B05B 11/3032 137/852

(Continued)

FOREIGN PATENT DOCUMENTS

GB 2463716 A 3/2010

*Primary Examiner* — Benjamin R Shaw
(74) *Attorney, Agent, or Firm* — The Webb Law Firm

(57) ABSTRACT

The invention relates to a dispenser for dispensing fluids from a fluid container, comprising a dispenser head provided with a dispenser nozzle; a dispenser base, holding the dispenser head, provided with a coupling for connection to the fluid container; and a fluid feed leading from the dispenser nozzle into the dispenser base for connection to the fluid container; wherein the fluid feed is provided with at least one valve. The invention also relates to a fluid container provided with a dispenser as well as a method for dispensing fluids from a fluid container.

10 Claims, 2 Drawing Sheets

(56) References Cited

U.S. PATENT DOCUMENTS

| | | | | | |
|---|---|---|---|---|---|
| 5,154,328 | A * | 10/1992 | Gueret | A45D 34/04 | 222/135 |
| 5,301,850 | A * | 4/1994 | Gueret | A45D 34/04 | 222/321.3 |
| 7,104,424 | B2 * | 9/2006 | Kolanus | B65D 83/753 | 177/245 |
| 7,762,435 | B2 * | 7/2010 | De'Padova | B29C 45/1676 | 222/402.13 |
| 8,602,265 | B2 * | 12/2013 | Decottignies | B05B 11/007 | 222/207 |
| 2002/0100772 | A1 * | 8/2002 | Bonningue | B05B 11/0016 | 222/321.2 |

* cited by examiner

DISPENSER AND METHOD FOR DISPENSING FLUIDS FROM A FLUID CONTAINER

CROSS-REFERENCE TO RELATED APPLICATIONS

This application is the United States national phase of International Application No. PCT/NL2014/050494 filed Jul. 21, 2014, and claims priority to Dutch Patent Application No. 2011199 filed Jul. 19, 2013, the disclosures of which are hereby incorporated in their entirety by reference.

BACKGROUND OF THE INVENTION

1) Field of the Invention

The invention relates to a dispenser and a fluid container provided with a dispenser, as well as a method for dispensing fluids from a fluid container.

2) Description of the Prior Art

Liquid dispensers are commonly used to dispense various liquid products like fluids, foams, aerosols, spray and so on. A field wherein these types of dispensers are specifically popular—though not exclusive—is personal care. The fluid dispensers are typically used such that the liquid is dispensed when a certain amount of pressure is applied to the dispenser. After the pressure is released however, residual liquid is often remaining at the dispenser and may even leak from the dispenser, resulting in a messy dispenser.

In the art, various dispensers are known. The American U.S. Pat. No. 3,991,916 discloses a dispenser having a valve in the fluid feed and a discharge orifice formed by a rigid wall zone and an elastically flexible wall zone. If expanding fluids, such as razor foam are used in this dispenser, the discharge opening prevents undesired leakage and spills. The manufacturing of the actuator head with the rigid wall zone and the elastically flexible wall zone in one piece is quite sophisticated.

The older American U.S. Pat. No. 3,138,301 discloses an alternative dispenser with a compressible metering chamber. This dispenser does not provide for a valve in the fluid feed, and is thus even more prone to spills and leakage.

The British patent application GB-A-2 463 716 discloses a dispenser, where no valve is present in the fluid feed. Although a compressible chamber is present for generating a reduced pressure, still spills from this chamber cannot properly be prevented.

The object of the invention is to overcome these drawbacks, or at least to offer a suitable alternative for a liquid dispenser that has no, or at least less, residue after dispensing.

SUMMARY OF THE INVENTION

The invention thereto proposes a dispenser for dispensing fluids from a fluid container comprising a dispenser head provided with a fluid feed for connecting to the fluid container, a dispenser nozzle which is connected to the fluid feed, a dispenser base holding the dispenser head, provided with a coupling for connection to the fluid container, the dispenser head is mounted in a reciprocating manner relative to the dispenser base, wherein the fluid feed comprises an orifice at the side, the nozzle comprises a flexible tube being connected to the orifice, such that in a downward position of the dispenser head the flexible tube is open, and in an upward position of the dispenser head the flexible tube is closed.

Fluid will be dispensed from the fluid container through the dispenser nozzle. The fluid is to be fed from the fluid container to the dispenser nozzle through a fluid feed, which is provided with flexible tube acting as a valve. The flexible tube ensures that the amount of residual fluid that is fed from the fluid container to the dispenser nozzle after completion of the dispensing is reduced, or even eliminated. Fluid is herein to be understood as for instance to be a liquid, a liquid/gas mixture, a gas, an aerosol, a paste, a foam or any combination of this type of fluids. The residual fluid is herein to be understood as the fluid that is fed to the nozzle after the dispensing has been stopped, i.e. after the user of the dispenser stops applying pressure to the dispenser.

The dispenser head may be arranged such that moving the dispenser head relative to the dispenser base from a closed position to a dispensing position allows fluid to escape from the dispenser nozzle at the dispenser head, and that the release of the dispenser head allows the dispenser head to return from a dispensing position to a closed position. For this, the dispenser base may have an opening at the side for passing-through the nozzle, such that in the downward position the orifice and the opening are substantially axially aligned, and in the upward position the orifice and the opening are axially misaligned. The dispenser head may be arranged such that it extends beyond the dispenser base when the dispenser is not being used and the head can be moved.

The flexible tube may for instance be located in the dispenser head. It is preferred that the flexible tube is located close to the dispenser nozzle, since the fluid can be stopped by the valve and the amount of residual fluid between the flexible tube and the dispenser nozzle is minimized. The flexible tube may however also be located in the dispenser base.

In order to feed the fluid to the dispenser nozzle, the dispenser may be provided with a pump mechanism connected in between the dispenser head and the dispenser base. Exerting pressure to such dispenser nozzle including a pump mechanism wherein the dispenser head is moved relative to the dispenser base, will result in a pumping action of the dispenser head. The pumping action will result in feeding gas (air) to the fluid container connected to the dispenser.

In an alternative situation, the dispenser may be placed on a propellant gas pre-pressurized fluid container, having a valve mechanism inside the container, having a valve stem extending from the top side of the fluid container. This valve stem is a raised tube, which upon exerting pressure thereon opens a valve inside the fluid container and allows the pressurized fluid to exit the fluid container trough the raised tube. In this alternative, the driving force is the propellant gas, so in this case no additional pump mechanism is needed.

The dispenser may be provided with a compressible chamber, which further reduces the residual fluid exiting the dispenser nozzle and may for instance be a bellow. Such a bellow may be compressed when pressure is applied to the dispenser head and when fluid is fed from the fluid container to the dispenser nozzle. When the pressure exerting on the dispenser nozzle decreases or stops the compressible chamber will return to its expanded shape. Due to the expansion of the compressible chamber, underpressure will occur in the expanding chamber with the effect that any residual fluid in the dispenser nozzle may be sucked back into the fluid feed, resulting in a cleaner dispenser nozzle.

The flexible tube in the fluid feed can be a passive one-direction fluid passage, which for instance blocks fluid in rest, and allows fluid to pass from the fluid feed to the dispenser nozzle when the flexible tube is actuated. Such actuation can be a movement of the dispenser head relative to the dispenser base. The flexible tube is then activated by the relative position of the dispenser head to the dispenser base.

The invention also relates to a fluid container with attached dispenser according to the invention. The fluid container can be pressurized such that it is under overpressure. Such a fluid container may for instance be filled with an aerosol. Pressurized fluid in the fluid container has the advantage that no pumping action is required to move the fluid from the fluid container to the dispenser nozzle.

The pressure in the fluid container may also be comparable to atmospheric pressure. In that case a pumping action may be required in order to urge the fluid from the fluid container to the dispenser nozzle.

The invention further relates to a method for dispensing fluids from a fluid container, comprising the method steps: providing a dispenser as disclosed above, pressing a dispenser head relative to a dispenser base from a closed position to a dispensing position to allow fluid to escape from a nozzle at the dispenser head; release of the dispenser head to allow the dispenser head to return from a dispensing position to a closed position; wherein during the release of the dispenser head the flexible connecting to the fluid feed is closed to block the fluid feed to the nozzle.

When fluid from the liquid container is required, the dispenser head may be moved relative to the dispenser base to a dispensing position, wherein fluid is allowed to escape from the dispenser nozzle. When sufficient fluid is expelled from the nozzle, the dispenser head may be moved to its initial closed position. During the release of the dispenser head, the flexible tube that is present in the fluid feed to the dispenser nozzle may be blocked, such that no fluid is allowed to pass the flexible tube and no fluid will exit from the dispenser nozzle. This reduces the amount of undesired residual from to leak from the dispenser nozzle when no fluid is requested.

During the release of the dispenser head underpressure may be exerted to the nozzle to retract fluid from the nozzle. Such underpressure can for instance be applied by a bellow that returns to its uncompressed state. The underpressure is sucking residual fluid from the dispenser nozzle in the direction of the fluid container, such that the residual fluid is not leaking from the nozzle after dispensing the fluid. The underpressure may be exerted to the nozzle at least partially before the nozzle is blocked, such that fluid is first drawn back from the nozzle, after which the nozzle is clear en is being blocked. This results in a clean dispenser nozzle.

Pressure may be built up in or released from a liquid container that is attached to the dispensed head by pressing the dispenser head relative to the dispenser base. The pressure that is accumulated this way may be used to pump fluid from the fluid container to the dispenser nozzle of the dispenser base.

BRIEF DESCRIPTION OF THE DRAWINGS

The invention is further elucidated on the basis of the non-limitative exemplary embodiment shown in the following figures. Herein show.

DETAILED DESCRIPTION OF THE INVENTION

Figure 1A:
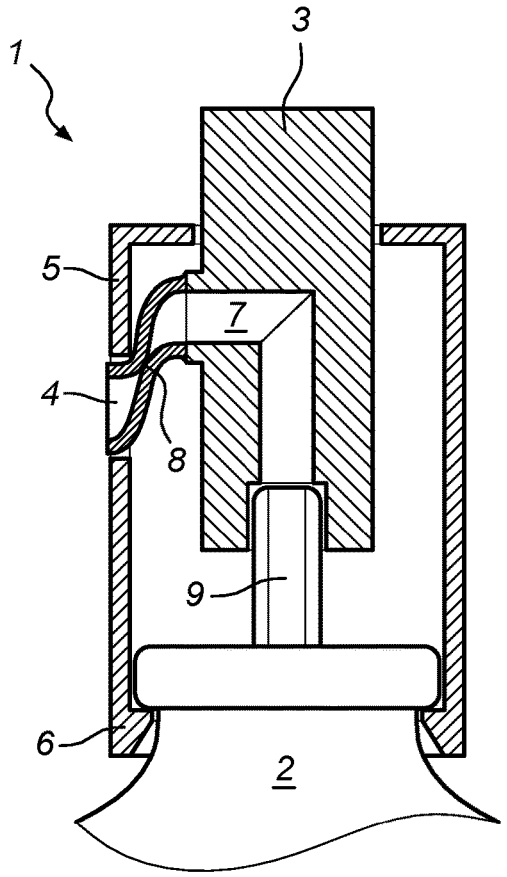
FIGS. 1A and 1B a dispenser according to the present invention.
Figure 1B:
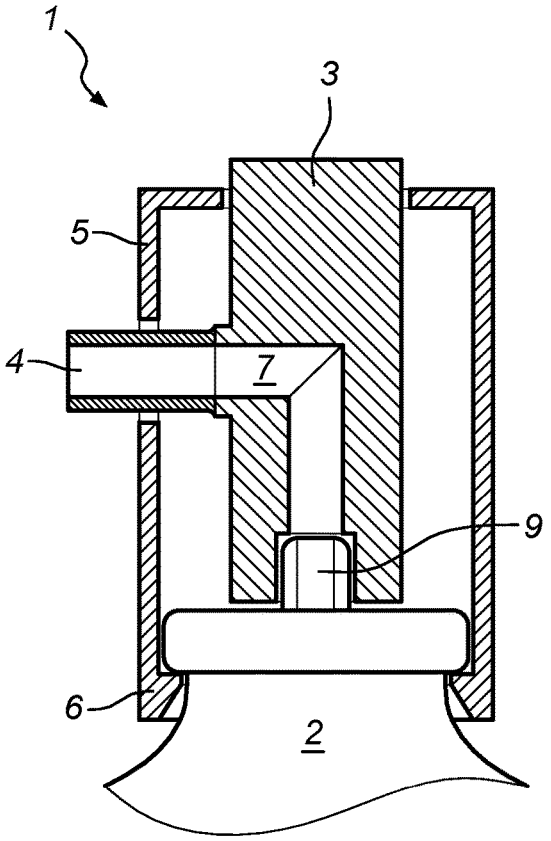

FIG. 1A and FIG. 1B show a dispenser (1) for dispensing fluids from a fluid container (2). The dispenser comprises a dispenser head (3) provided with a dispenser nozzle with opening (4) and further comprises a dispenser base (5), holding the dispenser head (3). The dispenser base (5) is provided with a coupling (6) for connection to the fluid container (2). The dispenser (1) further comprises a fluid feed (7) leading from the dispenser nozzle opening (4) into the dispenser base (3) for connection to the fluid container (2). The fluid feed (7) is provided with a flexible tube acting as a valve (8). The fluid feed (7) can be attached to the fluid container (2) in a fluid tight manner, such that no fluid is lost when fluid is dispensed from the fluid container (2).

FIG. 1A shows the dispenser (1) in rest, when no pressure is applied to the dispenser head (3). In this position the flexible tube (8) blocks the fluid feed (7) to the dispenser nozzle opening (4) such residual fluid is not able to pass from the fluid feed (7) to the dispenser nozzle opening (4).

FIG. 1B shows the dispenser (1) in action, when pressure is applied to the dispenser head (3). In this position there is no valve blocking the fluid feed (7) to the dispenser nozzle opening (4) such that fluid inside the fluid container (2), such as an aerosol can, may freely flow from the fluid container (2) to the dispenser nozzle opening (4). The fluid container (2) is equipped with additional valve means that are controlled by a raised tube (9) acting as a valve stem, which only allow fluid to exit the fluid container (2) when a certain pressure is applied to this raised tube valve stem (9).

FIG. 2A-FIG. 2E show a dispenser (10) for dispensing fluids from a fluid container (11). The dispenser (10) comprises a dispenser head (12) provided with a dispenser nozzle (13) and further comprises a dispenser base (14), holding the dispenser head (13), provided with a coupling (15) for connection to the fluid container (11). The dispenser (10) further comprises a fluid feed (16) leading from the dispenser nozzle (13) into the dispenser base (12) for connection to the fluid container (11). The fluid feed (16) is provided with a flexible tube (17) acting as a valve. The fluid feed (6) is further provided with a compressible bellow (18). Such a bellow (18) may be compressed when pressure is applied to the dispenser head (12). The bellow (18) is thus compressed when fluid is fed from the fluid container (11) to the dispenser nozzle (13), and can return to an expanded shape when no pressure is applied to the dispenser head (12). During the expansion of the bellow (18), any residual fluid in the dispenser nozzle (13) is sucked back into the fluid feed (16), resulting in a cleaner dispenser nozzle (13). The fluid feed (16) and/or bellow (18) can be attached to the fluid container (11) in a fluid tight manner, such that no fluid is lost when fluid is dispensed from the fluid container (11).

Figure 2A:
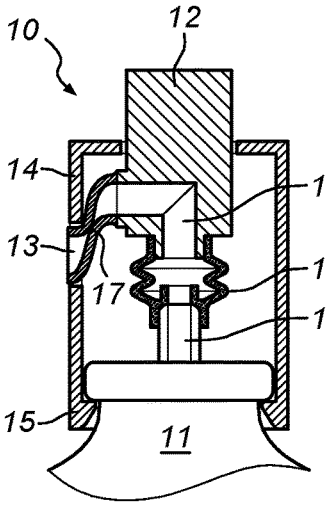
FIGS. 2A-2E a dispenser provided with a compressible bellow.

FIG. 2A shows the dispenser (10) in rest, when no pressure is applied to the dispenser head (12) and the flexible tube (17) closes of the fluid feed (16) to the dispenser nozzle (13).

Figure 2B:
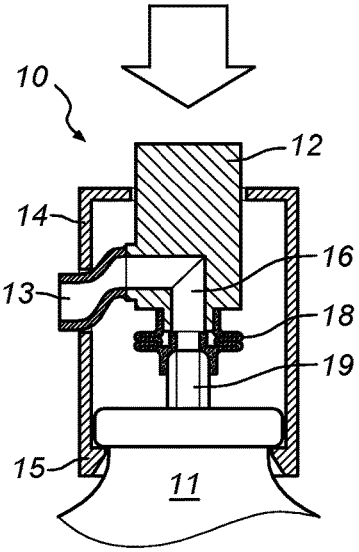

FIG. 2B shows the dispenser (10) when sufficient pressure is applied to the dispenser head (12) to compress the bellow (18) and to open the flexible tube (17) to allow fluid to pass from the fluid feed (16) to the dispenser nozzle (13). However, the applied pressure to a raised tube (19), which acts as a valve stem is not sufficient to open additional valve means of the fluid container (11) controlled by the raised tube valve stem (19) to allow fluid to exit.

Figure 2C:
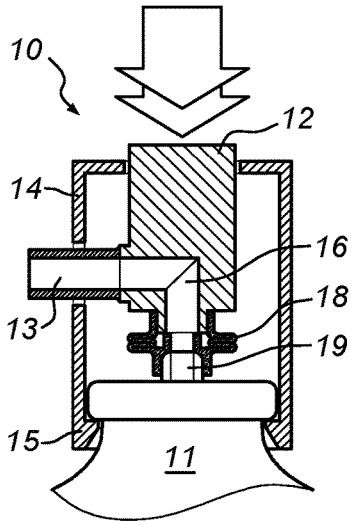

FIG. 2C shows the dispenser (10) when sufficient pressure is applied to the dispenser head (12) and the raised tube valve stem (19) such that fluid can flow from the fluid container (11) to the dispenser nozzle (13). The bellow (18) is in its compressed state and the valve (17) allows fluid to pass.

Figure 2D:
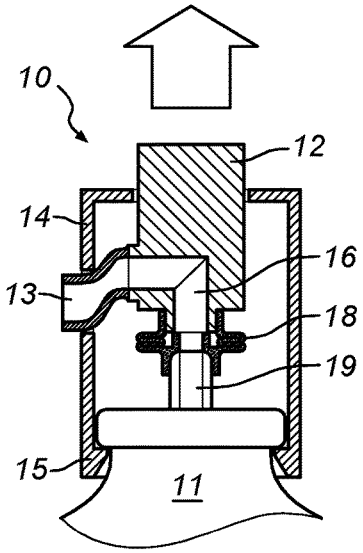

FIG. 2D shows the dispenser (10) when pressure on the dispenser head (12) is reduced such that fluid is able to pass from the fluid feed (16) to the dispenser nozzle (13), but the raised tube valve stem (19) is in it's closed off position again so fluids will not exit the fluid container (11).

Figure 2E:
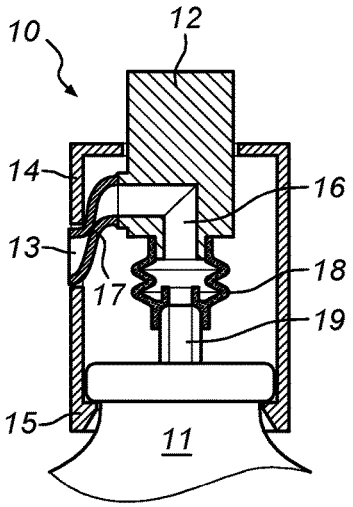

FIG. 2E shows the dispenser (10) returning to its rest position. The pressure is removed from the dispenser head (12). This results in an expanding bellow (18) that is sucking residual fluid from the nozzle (13) back into the fluid feed (16). Finally, flexible tube (17) returns to its closed state, such that no fluid is able to pass from the fluid feed (16) to the dispenser nozzle (13).

The technical features of the invention as illustrated here in the various embodiments of the method and device according the invention are not only disclosed in connection with the other technical features as shown in these examples but are also disclosed individually. Thus combinations of all the individual technical features disclosed with any other individual technical feature disclosed in this application is also to be understood as being disclosed here.

The invention claimed is:

1. A dispenser for dispensing a fluid from a fluid container comprising:

a dispenser head provided with a fluid feed for connecting to the fluid container, a dispenser nozzle which is connected to the fluid feed, a dispenser base holding the dispenser head, provided with a coupling for connection to the fluid container, the dispenser head is mounted in a reciprocating manner relative to the dispenser base, wherein the fluid feed comprises an orifice at the side, the nozzle comprises a flexible tube having a first end connected to the orifice and a second end opposite the first end, such that in a downward position of the dispenser head the flexible tube is open, and in an upward position of the dispenser head the first end and the second end of the flexible tube are open and a portion of the flexible tube between the first end and the second end is closed, and wherein the dispenser base comprises an opening at the side for passing-through of the nozzle, such that in the downward position the orifice and the opening are substantially axially aligned, and in the upward position the orifice and the opening are axially misaligned.

2. The dispenser according to claim 1, wherein the flexible tube is a passive one direction fluid passage.

3. The dispenser according to claim 1, wherein the flexible tube is activated by the relative position of the dispenser head to the dispenser base.

4. A fluid container with attached dispenser according to claim 1, wherein the fluid container is under overpressure.

5. A fluid container with attached dispenser according to claim 1, wherein the pressure in the fluid container is comparable to atmospheric pressure.

6. A method for dispensing fluids from a fluid container, comprising the method steps:

A) providing a dispenser;

B) pressing a dispenser head relative to a dispenser base from a closed position to a dispensing position to allow fluid to escape from an orifice at the dispenser head;

C) releasing the dispenser head to allow the dispenser head to return from the dispensing position to the closed position;

wherein during the release of the dispenser head according to method step C) a flexible tube having an open first end connecting to the orifice and an open second end opposite the open first end is closed at a portion between the open first end and the open second end to block the fluid feed to an opening in the dispenser base, wherein during the pressing of the dispenser head according to method step B) the orifice and the opening become substantially axially aligned, and wherein during the release of the dispenser head according to method step C) the orifice and the opening become axially misaligned.

7. The dispensing method according to claim 6, wherein during the release of the dispenser head according to process step C) underpressure is exerted to the opening or nozzle to retract fluid from the nozzle.

8. The dispensing method according to claim 7, wherein during process step C) the underpressure is exerted to the opening or nozzle at least partially before the nozzle is blocked.

9. The dispensing method according to claim 6, wherein during process step B) by pressing the dispenser head relative to the dispenser base a pressure is built up in a liquid container that is attached to the dispensed head.

10. The dispensing method according to claim 6, wherein during process step B) by pressing the dispenser head relative to the dispenser base a pressure in a liquid container that is attached to the dispensed head is released.

* * * * *